United States Patent [19]

Speers

[11] 4,196,539

[45] Apr. 8, 1980

[54] TOY ILLUMINATING ASSEMBLY

[75] Inventor: Samuel F. Speers, North Attleboro, Mass.

[73] Assignee: Hasbro Industries, Inc., Pawtucket, R.I.

[21] Appl. No.: 879,907

[22] Filed: Feb. 21, 1978

[51] Int. Cl.[2] ..... G09F 13/16

[52] U.S. Cl. ..... 46/16; 40/547; 40/561; 40/579

[58] Field of Search ..... 40/547, 559, 579, 501, 40/546, 561, 582, 583; 46/16, 17

[56] References Cited

U.S. PATENT DOCUMENTS

| | | | |
|---|---|---|---|
| 661,551 | 3/1929 | Costier | 40/561 |
| 1,845,530 | 2/1932 | Tarallo | 40/547 |
| 2,151,236 | 3/1939 | Schwartz et al. | 40/559 |
| 2,200,339 | 5/1940 | Nelson et al. | 40/561 X |
| 3,530,615 | 9/1970 | Meyer | 46/16 |
| 3,568,357 | 3/1971 | Lebensfeld | 40/547 X |

*Primary Examiner*—John F. Pitrelli
*Attorney, Agent, or Firm*—Salter & Michaelson

[57] ABSTRACT

A toy assembly is presented wherein board means is adapted to receive a plurality of separate light transmitting pegs. The board means generally forms the bottom wall of an enclosure in turn provided with a generally planar cover such that the pegs and other includable portions of the toy may be conveniently stored therein. The inner surface of the cover is provided with a light reflective surface that is upwardly disposed when the cover has been removed and attached to the toy so as to serve as a support for the board means. The board means is disposed at an acute angular relationship to the reflective surface such that light incidence upon said surface is reflected to those peg portions disposed in the board means. This construction eliminates the need of an included light source with the toy as well as forming of a self-contained storage and transport container.

13 Claims, 8 Drawing Figures

TOY ILLUMINATING ASSEMBLY

BACKGROUND AND SUMMARY OF THE INVENTION

This invention relates to a toy or game device and particularly one in which a plurality of light transmitting pegs may be assembled in various patterns or pictures. Light from a source behind the board means is transmitted through the pegs so as to enhance the beauty of the designs or pictures so formed. An assembly toy utilizing these concepts is presently made by the assignee of the instant application, namely, Hasbro Industries, Inc. and is sold under the trademark LITE-BRITE. This toy utilizes a housing in which a light bulb is mounted such that light is transmitted through pegs disposed within a screen forming a top portion of the enclosure. While this game has high interest value and has proven to be highly successful, it would be desirable to be able to use an already available source of light such as sunlight or house lamps to illuminate the pegs, thereby eliminating the electrical requirements inherently necessary where a built-in light source is a part of the game.

It is accordingly a primary object of the present invention to provide a toy illuminating device of the above described general type in which a toy incorporated light source is not required and that light needed for the operation of the device may be utilized from otherwise available sources.

A further object of the present invention is the provision of a toy illuminating device of the aforementioned type in which light incident upon a reflective surface is utilized as the illuminating light source.

A still further object of the present invention is the provision of a device of the immediately aforementioned type which additionally serves as a container suitable for the transport and storage of the pegs and associated art materials of such a toy.

These and other objects of the present invention are accomplished by the provision of a container base, the bottom surface thereof including an apertured board into or through which the several pegs necessary to form a particular pattern or design may project. The container base includes upwardly directed sidewalls which serve to create a shadow box effect and a top cover is slidably received thereby. In the use position of the toy, the cover is used to support the board in an upright acute angular position with respect thereto. That surface of the cover which is disposed upright in the use position is provided with a reflective surface such that light incident upon that surface is upwardly reflected to the board so as to be transmitted to the other side thereof by the light transmitting pegs. In this manner then, not only is the previous need for a separate light source eliminated, but a container, useful in the transport and storage of the toy, is simultaneously provided.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
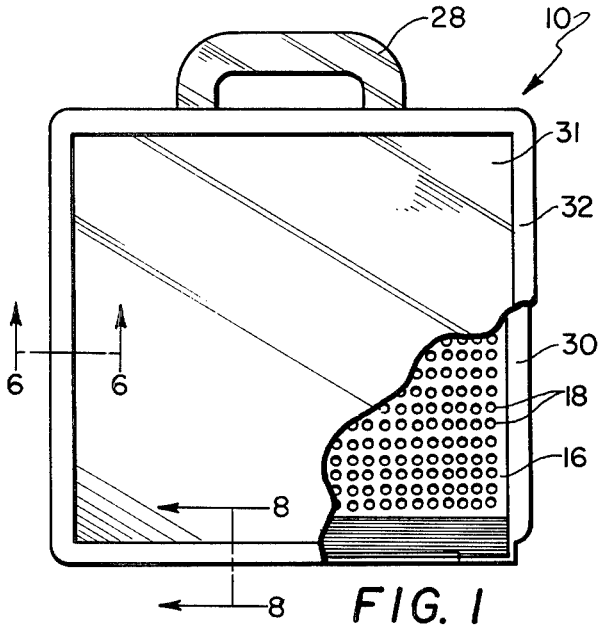
FIG. 1 is a top plan view of the toy of the present invention in a closed storage position with parts broken away for clarity.
Figure 2:
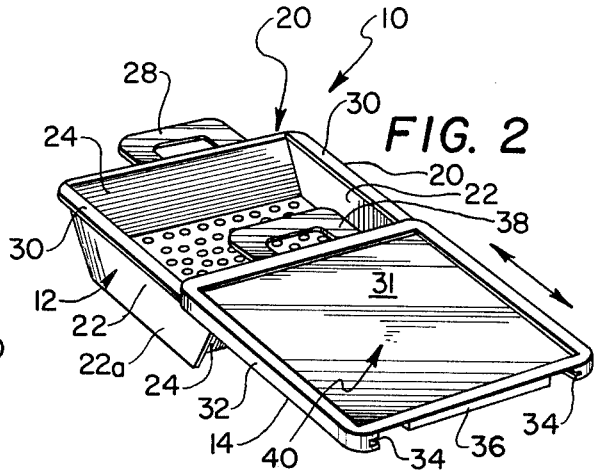
FIG. 2 is a perspective view showing the manner in which the members of the present invention slidably cooperate so as to form the container shown in FIG. 1.

The toy 10 of the present invention is shown in a closed or storage position in both FIGS. 1 and 2 of the drawing. Therein, a first member 12 forms a container base of the toy and a second member 14 forms a cover therefor. The base 12 includes a bottom wall 16, in turn provided with a plurality of openings 18 extending therethrough in such a manner so as to provide the board means of the present invention. The overall configuration of the base 12 is that of a somewhat rectangular container and includes sidewalls 20 upwardly extending from the periphery of the bottom wall 16, it being understood that the bottom wall 16 may be either integral therewith or separable therefrom as by the provision of conventional locking means (not shown). The sidewalls include a pair of spaced longitudinally disposed sidewalls 22 terminating in protective flanges **22*a* and a pair of similarly spaced interconnecting laterally disposed sidewalls 24. The sidewalls 22 and 24 are either interconnected or integrally formed with each other and they, in effect form a shadow box for the bottom wall 16**.

One of the laterally extending sidewalls 24 is provided with a downwardly extending generally U-shaped cut-out portion 26 for a purpose which will hereinafter be more fully explained. Such sidewall 24 upwardly outwardly extends from the bottom wall 16 so as to form an obtuse angle therewith. The opposite sidewall 24 may also be similarly disposed with regard to the bottom wall 16 and is further provided with a longitudinally outwardly extending handle segment 28. Each of the longitudinally extending sidewalls 22 is provided with a laterally outwardly extending terminal flange 30.

The first member or cover 14 includes a generally planar rectangular sheet 31 having a vertically extending rib 32 on opposite longitudinally extending edges thereof. The ribs are further provided with a longitudinally directed slot 34 such that the ribs and slots cooperatively form a channel for receipt of the spaced flanges 30 such that the cover 14 may be longitudinally slidably disposed with regard to the base portion 12, as best illustrated in FIG. 2. One of the laterally extending edges of the cover 14 is provided with an inwardly directed longitudinally extending clip 36 for a purpose which will hereinafter be more apparent, and the opposite edge thereof is provided with an outwardly longitudinally extending handle segment 38. The handle segments 28 and 38 are adapted for aligned disposition with regard to one another when the device is disposed in closed or storage position. The formation of the resultant carrying handle from the handle segments 28 and 38 respectively positioned on the base 12 and cover 14, assures that once aligned and used for this purpose, that the cover and base portions will be prevented from relative longitudinal movement with respect to each other. This action assures that the container resulting from said aforementioned cooperation between the members 12 and 14 is maintained closed while being transported.

The surface 40 of the cover 14 which is disposed uppermost in the closed storage position as shown in FIGS. 1 and 2 is generally provided with identification and instructional material concerning the toy either in the form of direct printing thereon or as a separate sheet or panel adhered thereto in a conventional manner such as by adhesive means. It should also be pointed out that for increased molding efficiency when the members are formed from resinous plastic materials, as by injection molding, that the rib 32 may take the form of interconnected spaced segments and that an opening co-extension with the clip 36 may be disposed through the sheet 31.

Figure 3:
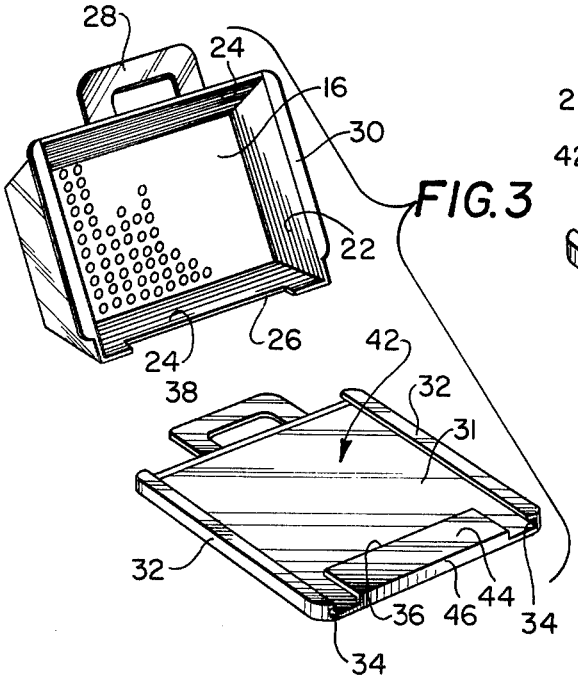
FIG. 3 is a perspective assembly view showing the members of the present invention preparatory to being disposed in their use position.
Figure 4:
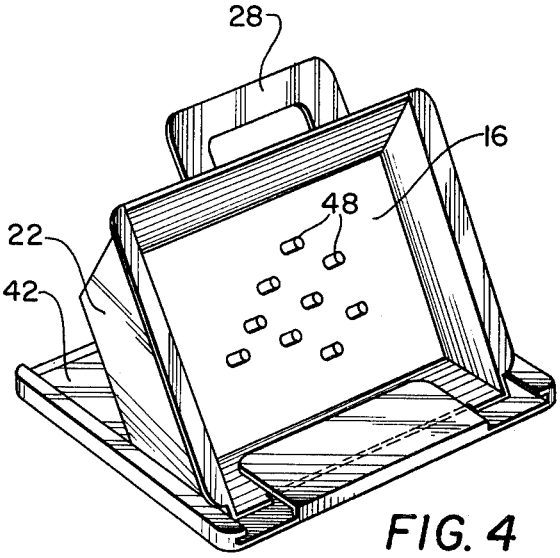
FIG. 4 is a perspective view showing the members disposed in such use position wherein the container base portion thereof is disposed in an upright position.
Figure 8:
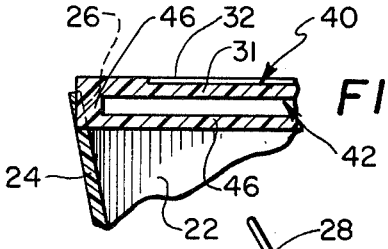
FIG. 8 is a partial cross sectional view taken along the line 8—8 of FIG. 1.
Figure 6:
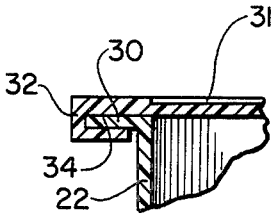
FIG. 6 is a partial sectional view through the line 6—6 of FIG. 1.
Figure 7:
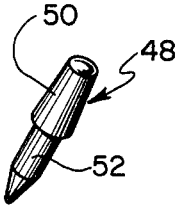
FIG. 7 is a perspective view of the light transmitting pegs.
Figure 5:
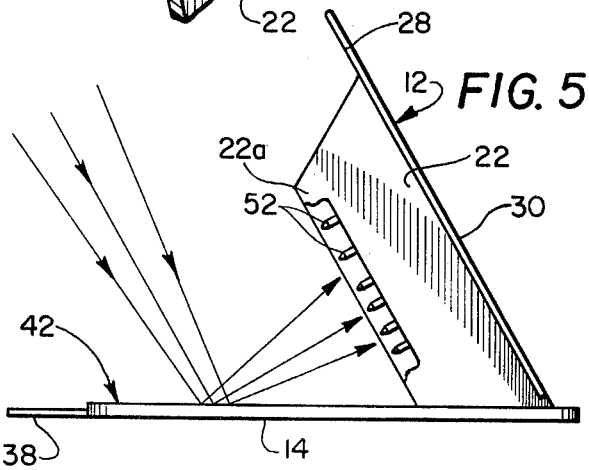
FIG. 5 is a side view of the device shown in FIG. 4 with one of the protective flanges broken away and shows in particular the manner in which light is reflected to the board means thereof.

Turning now to FIGS. 3 through 5 in particular, the manner in which the toy 10 may be assembled in its use position is best illustrated. In that regard, the surface of the sheet 31 opposite surface 40 is provided with a light reflective surface 42 which may take the form of a separate sheet such as a sheet of foil adhered thereto or by painting such surface with a light colored, i.e. white and preferably glossy paint. Furthermore, the detailed structure of the clip 36 includes a plate portion 44 extending longitudinally inwardly from one of the laterally extending edges of the cover 14 and a connector 46 connecting such plate to the edge. The plate 44 may accordingly be somewhat flexed away from the sheet 31 such that the leading edge of the sidewall 24 not provided with a handle segment 28 may be slidably disposed thereunder in such a manner that portions of such sidewall 24 are maintained in engagement with the upper reflective surface 42 of the sheet. The first member or base 12 is thus disposed in regard to the second member or cover 14 so that the bottom wall 16 which forms the board means is disposed in an acute angular relationship to the reflective surface 42. In this manner then, light reflective pegs 48 including a head portion 50 and a narrow, pointed shaft portion 52 may be inserted into the openings 18 such that portions of the shaft 52 preferably project behind the board means. Thus, an independent light source such as sunlight or any convenient household lamp may be used to direct light upon reflective surface 42, which light will be upwardly reflected towards the board means so that the pattern or picture outlined by the several pegs will be visibly illuminated when viewed from the front of the base member 12, that is, from the right of FIG. 5.

The clip 36 is generally centrally disposed with regard to the terminal edge of the sheet in which it extends such that when the second member 14 is used as a cover, the added thickness caused by such clip 36 will be accommodated by the cut-out 26. Furthermore, and as best seen in FIG. 4, the ribs upwardly extend from the reflective surface 42 in such a manner that the longitudinally extending sidewalls 22 of the first member 12 are disposed proximate thereto such that the first member is effectively restrained from excess lateral movement in regard to the second member 14 in its upright use position.

Pegs of various colors may be utilized in forming different designs or patterns upon the bottom wall 16 forming the board means. It is also contemplated that paper sheets previously marked with patterns and instructions for the placement of pegs may be placed upon the upper surface of the bottom wall 16 previous to the receipt of the pegs through the openings 18, all as well known in the art. It should also be pointed out that it is not necessary that the narrowed shaft portions 52 of the pegs extend entirely through or accordingly project below the bottom surface 16. However in those cases where the shaft portions 52 do project through the wall 16, the protective flanges *22a* will prevent the pegs from being dislodged should the container 12 be laid flat on a horizontal surface. More specifically, if the container 12 has pegs projecting through bottom wall 16, and if the container is placed on a horizontal surface, the flanges *22a* will engage the surface, thus preventing the pegs from becoming dislodged.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy illuminating assembly comprising an open top member including apertured board means at least in part forming a lower wall thereof, said board means adapted to receive a plurality of light transmitting pegs which may be assembled thereon in varying patterns such that a portion of the pegs extend into said board means, sidewalls upwardly extending from said lower wall so as to define an enclosure base, and a generally planar second member adapted in a storage position to form a top cover for said first member, said second member having one surface thereof light reflective and further adapted in an alternative use position thereof to form a support for said first member so as to support said first member in an upright attitude such that the board means thereof is disposed at an acute angle to said reflective surface and so that light incident upon said surface will be reflected to those pegs disposed in said board means.

2. The device of claim 1, wherein one of said sidewalls is upwardly outwardly angularly disposed with regard to said lower wall such that said angularly disposed sidewall contacts and supports said second member in said alternate position.

3. The device of claim 2, said second member including clip means engaging portions of said angularly disposed sidewall for maintaining said first member in said alternate position.

4. The device of claim 1, those sidewalls laterally spaced from each other and laterally spaced portions of said cover provided with means forming a pair of cooperating flanges and channels whereby said cover is longitudinally removably slidably engaged with said enclosure base.

5. The device of claim 3, said clip means being a single clip inwardly extending from one laterally disposed edge of said second member.

6. The device of claim 5, including handle segments cooperating to form a handle, one of said handle segments outwardly longitudinally extending from the opposite laterally disposed edge of said second member and the other of said handle segments longitudinally outwardly extending from the sidewall opposite said angularly disposed sidewall.

7. The device of claim 4, a pair of longitudinally extending sidewalls disposed between said laterally extending sidewalls, said flanges laterally extending from each of said longitudinal sidewalls and said channels formed at longitudinal edges of said second member, said channels upstanding from said reflective surface and positioned proximate said longitudinal sidewalls so as to restrain said first member from lateral movement in said alternate position.

8. The device of claim 1, said board means conprising a panel having a plurality of openings therethrough removably disposed with respect to said sidewalls to form said lower wall.

9. The device of claim 1, said lower wall integral with said sidewalls.

10. The device of claim 1, said reflective surface being a foil layer attached to said second member.

11. The device of claim 1, said reflective surface being a painted surface of said second member.

12. The device of claim 1, said reflective surface being inwardly disposed when said second member is in its said top cover position.

13. The device of claim 1, said sidewalls extending beneath said lower wall to define protective flanges at opposite sides of said lower wall.

* * * * *